US007603778B1

(12) United States Patent
Lerch

(10) Patent No.: US 7,603,778 B1
(45) Date of Patent: Oct. 20, 2009

(54) FOLDING KNIFE HAVING TWO MODES OF OPERATION

(76) Inventor: Matthew J. Lerch, N88 W23462 North Lisbon Rd., Sussex, WI (US) 53089

( * ) Notice: Subject to any disclaimer, the term of this patent is extended or adjusted under 35 U.S.C. 154(b) by 266 days.

(21) Appl. No.: 11/830,583

(22) Filed: Jul. 30, 2007

(51) Int. Cl.
*B26B 1/04* (2006.01)

(52) U.S. Cl. ..... 30/160; 30/161

(58) Field of Classification Search ..... 30/158, 30/159, 160, 155, 161, 164
See application file for complete search history.

(56) References Cited

U.S. PATENT DOCUMENTS 5,819,414 A 10/1998 Marifone ..... 30/160
2002/0104220 A1* 8/2002 Marfione ..... 30/160
2008/0201953 A1* 8/2008 Bremer et al. ..... 30/160
2009/0144985 A1* 6/2009 Liu ..... 30/158

* cited by examiner

*Primary Examiner*—Stephen Choi
(74) *Attorney, Agent, or Firm*—Donald J. Ersler

(57) ABSTRACT

A knife having two modes of operation includes a blade member, a first side plate, a second side plate, a spacer, a mode lever, and a linear spring. The spacer is disposed between the first and second side plates in an upper area thereof. A pivoting end of the blade member is pivotally retained between first ends of the first and second side plates. The mode lever is pivotally retained between the second ends of the first and second side plates, below the spacer. The linear spring is pivotally retained between the first and second side plates, below the spacer such that one end thereof engages one of two positions on the mode lever. A release button must be depressed to allow the blade member to pivot outward into an extended position in either mode.

17 Claims, 9 Drawing Sheets

FOLDING KNIFE HAVING TWO MODES OF OPERATION

BACKGROUND OF THE INVENTION

1. Field of the Invention

The present invention relates generally to folding tools and more specifically to a folding knife having two modes of operation which may be set into a manual mode or a spring assisted mode.

2. Discussion of the Prior Art

It appears that no folding knifes exist which may be switched from spring assisted to manual operation or manual to spring assisted operation. U.S. Pat. No. 5,819,414 to Marifone discloses a folding knife which may be opened in a manual or spring assisted mode. However, this knife may not be preset to open in one of a manual or spring assisted mode.

Accordingly, there is a clearly felt need in the art for a folding knife having two modes of operation which allows thereof to be set to open in one of a manual mode or a spring assisted mode.

SUMMARY OF THE INVENTION

The present invention provides a folding knife having two modes of operation allowing thereof to be set to open in one of two different modes. The knife having two modes of operation includes a blade member, a first side plate, a second side plate, a spacer, a mode lever, and a linear spring. The spacer is disposed between the first and second side plates in an upper area thereof. A pivoting end of the blade member is pivotally retained between first ends of the first and second side plates. The mode lever is pivotally retained between the second ends of the first and second side plates, below the spacer.

The linear spring is pivotally retained between the first and second side plates, below the spacer such that one end thereof engages one of two steps on the mode lever. The mode lever includes a spring assisted step and a manual step. The spring assisted step provides spring assisted opening of the blade member through a release button and the manual step requires manual opening of the blade member with fingers. The other end of the linear spring puts pressure on the blade member when in spring assisted mode. The linear spring is forced against one of the steps on the mode lever through a step spring. The mode lever is locked into a specific mode with a mode spring. Both the step and mode springs are retained by the spacer.

A release button is pivotally retained in the second side plate. The release button must be depressed to allow the blade member to pivot outward into an extended position. A lock bar is retained in the first side plate. The lock bar prevents the blade member from pivoting out of an extended position. Other methods of retaining the blade member in an extended position may be used besides the lock bar.

Changing modes requires the blade member to be in an extended position. Changing from a spring assisted mode to a manual mode of operation, requires that a bottom of the mode lever be pushed inward. Changing from a manual mode to a spring assisted mode requires that a tool be slipped between the first and second side, adjacent the mode lever. The linear spring is forced upward with the tool until it contacts a bottom of the spacer. The one end of the linear spring will go into the spring assisted step on the mode lever.

Accordingly, it is an object of the present invention to provide a folding knife having two modes of operation which requires a tool to set thereof into a spring assisted mode.

Finally, it is another object of the present invention to provide a folding knife having two modes of operation which may be set into either a manual or a spring assisted mode.

These and additional objects, advantages, features and benefits of the present invention will become apparent from the following specification.

DETAILED DESCRIPTION OF THE PREFERRED EMBODIMENTS

Figure 1:
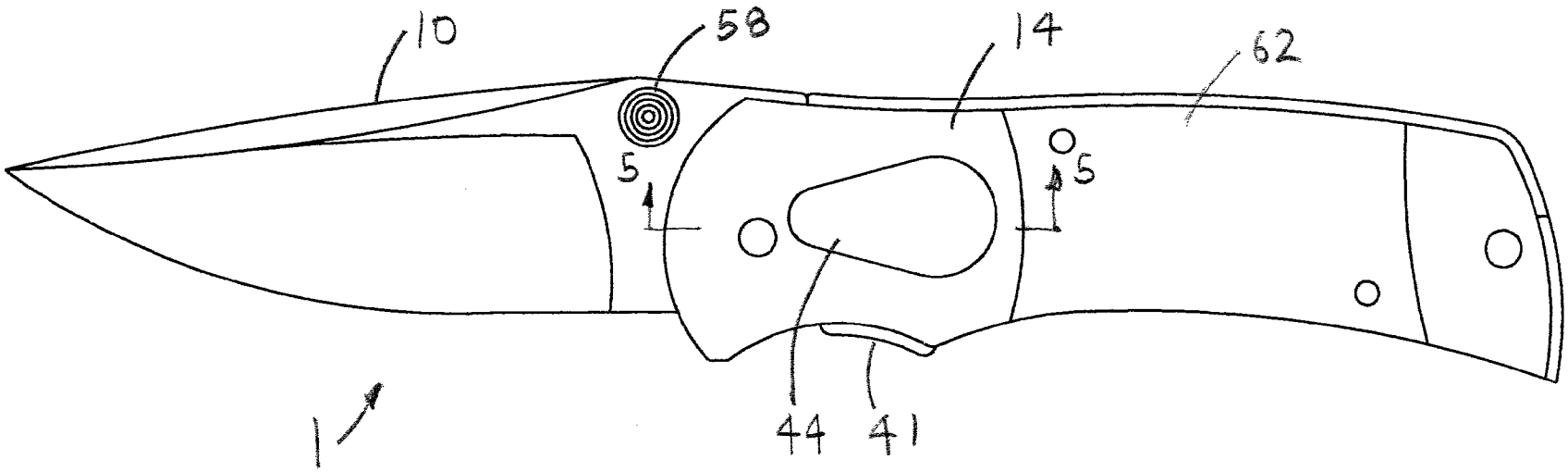
FIG. 1 is a front view of a folding knife having two modes of operation in accordance with the present invention.
Figure 1A:
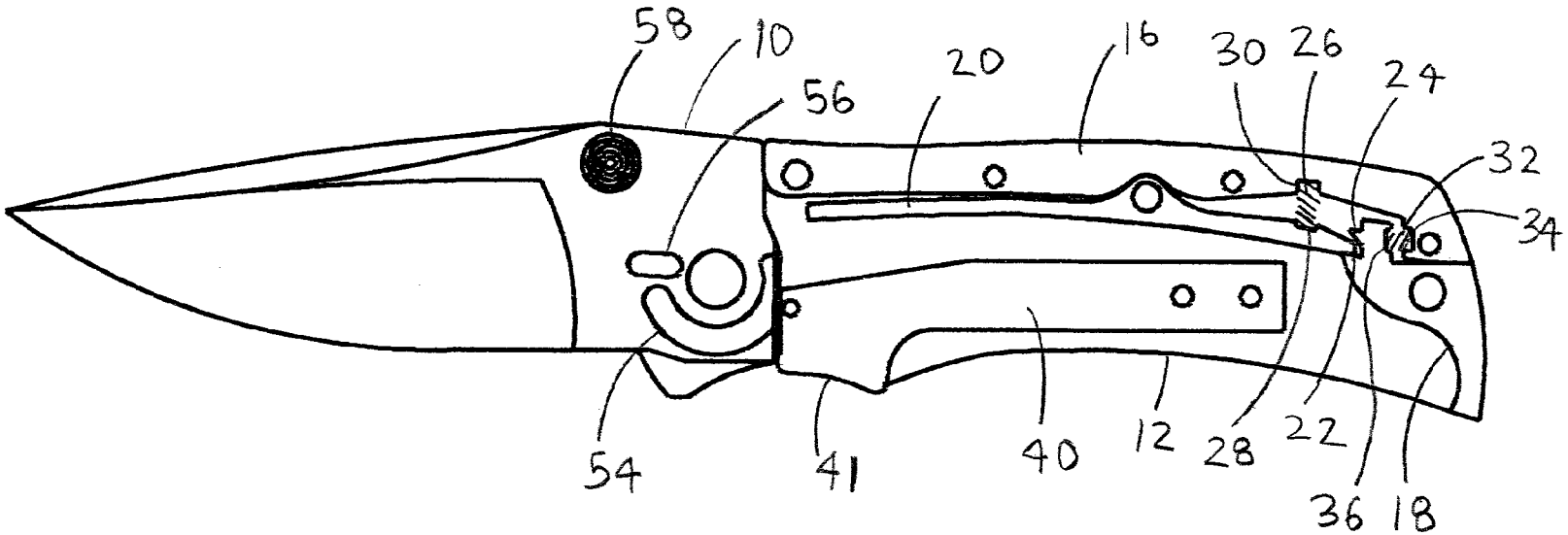
FIG. 1*a* is a front view of a folding knife having two modes of operation with a second side plate removed in accordance with the present invention.
Figure 2:
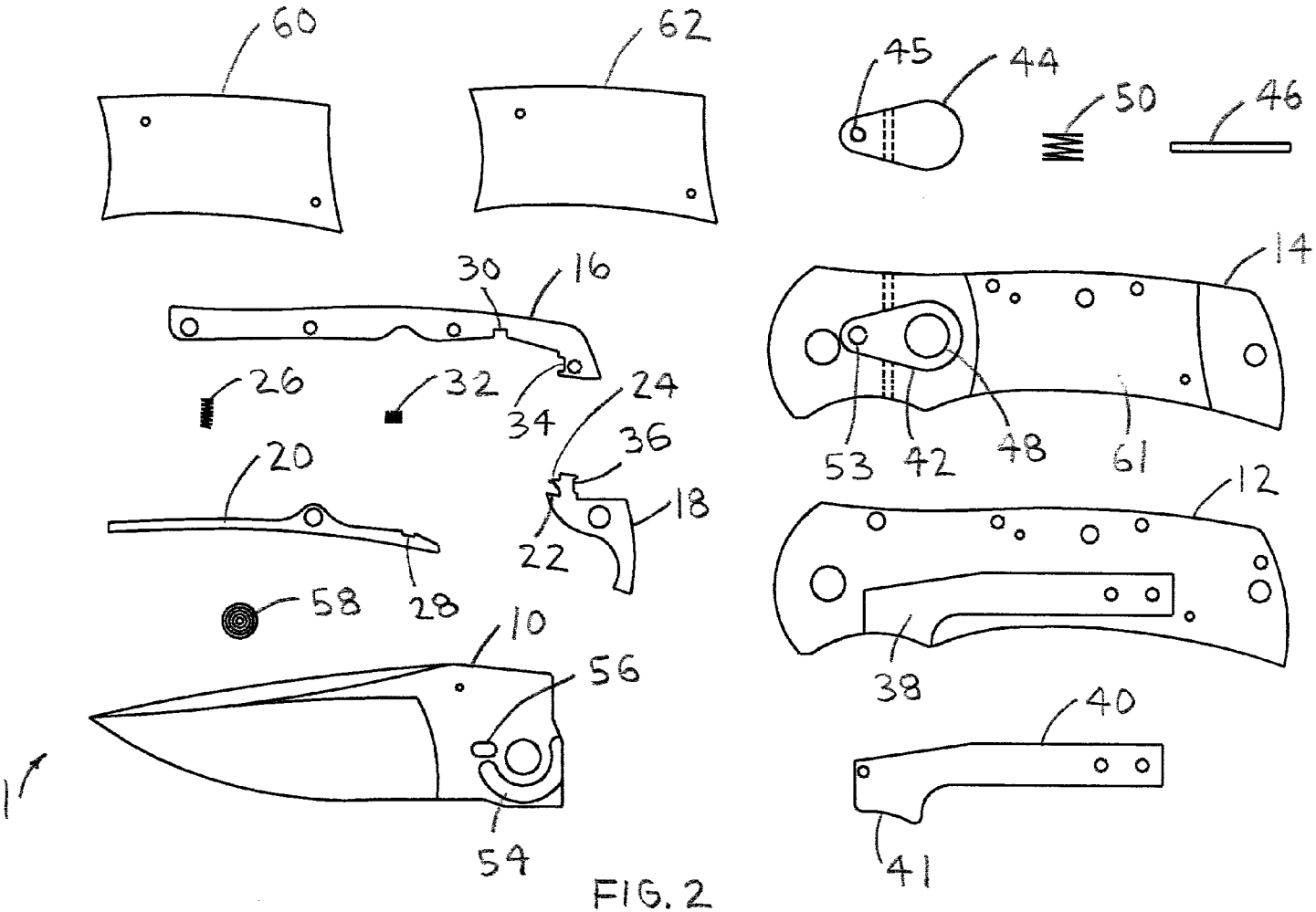
FIG. 2 is a front exploded view of a folding knife having two modes of operation in accordance with the present invention.
Figure 3:
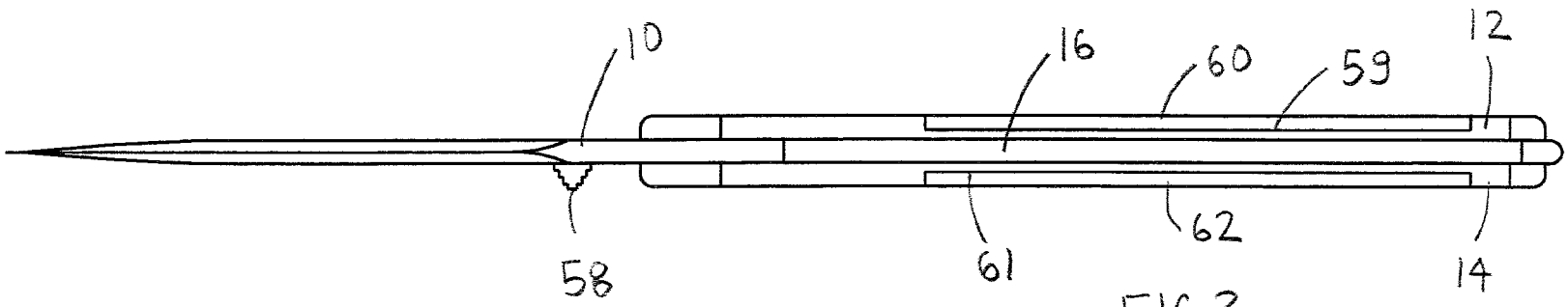
FIG. 3 is a top view of a folding knife having two modes of operation in accordance with the present invention.
Figure 4:
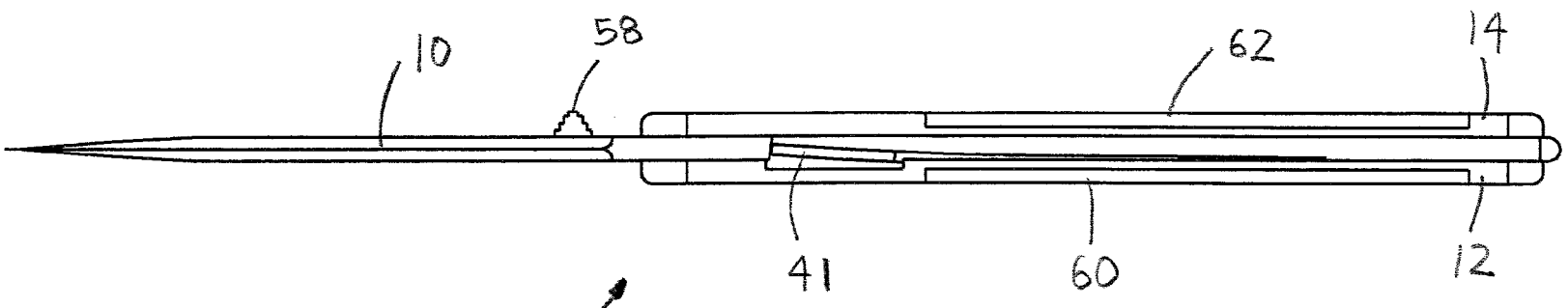
FIG. 4 is a bottom view of a folding knife having two modes of operation in accordance with the present invention.

With reference now to the drawings, and particularly to FIG. 1, there is shown a front view of a folding knife having two modes of operation (folding knife) 1. With reference to FIGS. 2-4, the folding knife 1 includes a blade member 10, a first side plate 12, a second side plate 14, a spacer 16, a mode lever 18, and a linear spring 20. Fasteners and assembly methods used to assembly elements of folding knifes are well known in the art and need not be covered in detail. The spacer 16 is preferably secured between the first and second side plates in an upper area with dowels and threaded fasteners, but other fasteners or attachment methods may also be used. A pivoting end of the blade member 10 is pivotally retained between first ends of the first and second side plates with any suitable retention method. The mode lever 18 is pivotally retained between the second ends of the first and second side plates, below the spacer 16 with any suitable retention method. A manual step 22 is formed on a first end of the mode lever 18 and a spring assisted step 24 is formed on the first end of the mode lever 18, above the manual step 22.

The linear spring 20 is pivotally retained between the first and second side plates, below the spacer 16 such that one end thereof is capable of engaging either the manual or spring assisted steps. The linear spring 20 is pivotally retained between the first and second side plates with any suitable retention method. A step spring 26 biases the one end of the linear spring 20 against a bottom of either the manual or spring assisted steps. Preferably, a linear step slot 28 is formed in the linear spring 20 to capture one end of the step spring 26 and a spacer step slot 30 is formed in the spacer 16 adjacent the linear step slot 28 to receive the other end of the step spring 26. A mode spring 32 forces the first end of the mode lever 18 against the one end of the linear spring 20 to retain the linear spring 20 in one of the two steps. Preferably, a spacer mode slot 34 is formed in the spacer 16 to capture one end of the mode spring 32 and a lever mode slot 36 is formed in the mode lever 18 adjacent the spacer mode slot 34 to capture the other end of the mode spring 32.

When the one end of the linear spring 20 is located in the spring assisted step 24; the blade member 10 is released into an extended position by depressing a release button 44. When the one end of the linear spring 20 is located in the manual step 22; the blade member 10 must be manually rotated to an extended position. The release button 44 must also be depressed to manually rotate the blade member 10 into an extended position. The other end of the linear spring 20 puts pressure on the blade member 10 when located in the spring assisted step 24. Preferably, a lock bar slot 38 is formed in the first side plate 12 to receive a lock bar 40. One end of the lock bar 40 is attached to the first side plate 12 with suitable fasteners. A thumb tab 41 is formed on the other end of the lock bar 40. The thumb tab 41 normally extends upward out of the lock bar slot 38 (see FIG. 4) to prevent the blade member 10 from rotating out of an extended position. The thumb tab 41 must be pushed into the lock bar slot 38 to allow rotation of the blade member 10 out of the extended position. Other methods of retaining the blade member 10 in an extended position may be used besides the lock bar 40.

Figure 5:
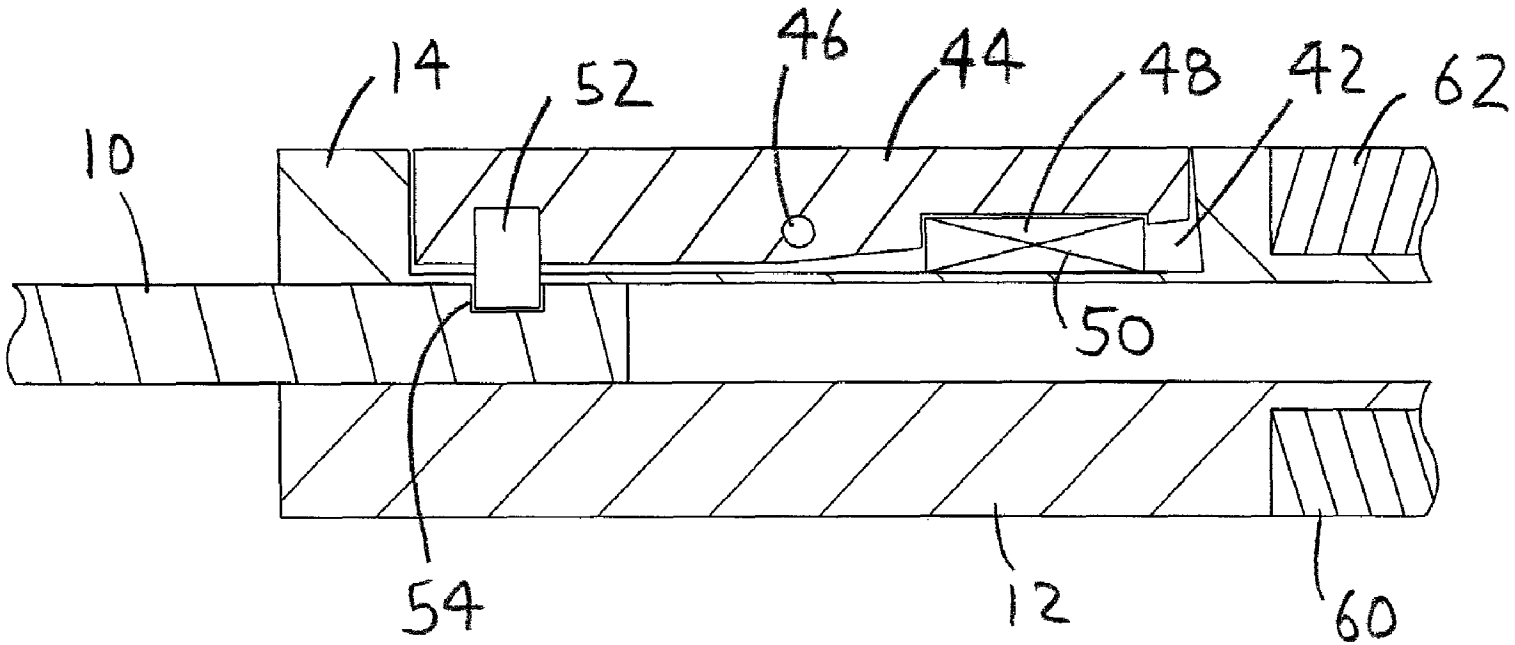
FIG. 5 is a partial cross sectional view of a release button of a folding knife having two modes of operation in accordance with the present invention.
Figure 6:
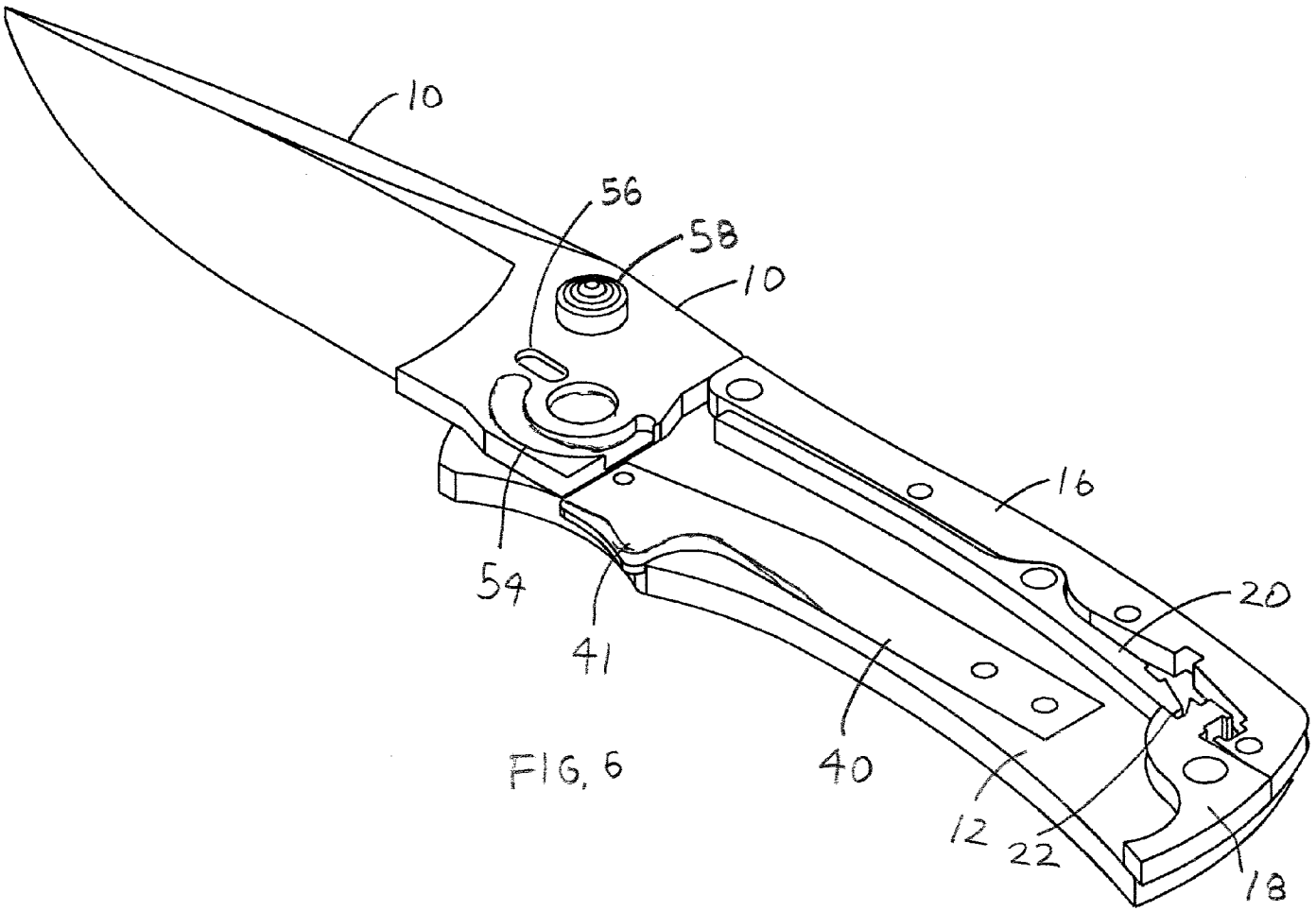
FIG. 6 is a perspective view of a folding knife having two modes of operation with a second side plate removed and set in a manual mode in accordance with the present invention.
Figure 7:
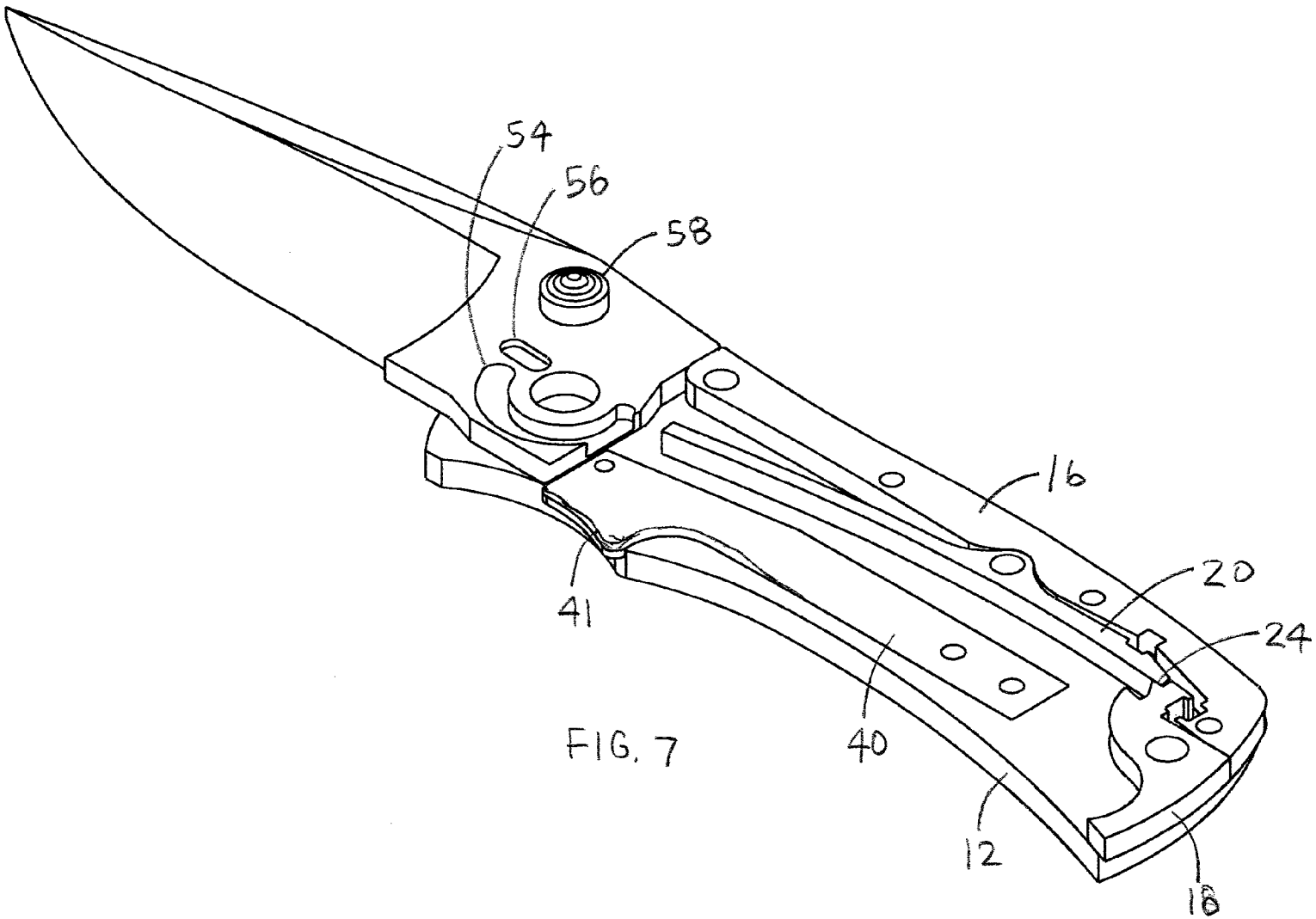
FIG. 7 is a perspective view of a folding knife having two modes of operation with a second side plate removed and set in a spring assisted mode in accordance with the present invention.

With reference to FIG. 5, a release button cavity 42 is formed in the second side plate 14 to receive a release button 44. Preferably, a pivoting dowel 46 is inserted through the second side plate 14 and the release button 44 to allow the release button 44 to pivot relative to the second side plate 14. A spring bore 48 is formed in the second side plate 14 to receive a button spring 50. A lock pin 52 is pressed into a hole 45 in the release button 44. A pin clearance hole 53 is formed through the second side plate 14 to provide clearance for the lock pin 52. With reference to FIGS. 6 and 7, the lock pin 52 rests in a ramp slot 54 when the blade member 10 is in an extended position. When the blade member 10 is in a retracted position, the lock pin 52 is disposed in a lock cavity 56 to prevent the blade member 10 from rotating out of a retracted position. The release button 44 must be depressed to pull the lock pin 52 out of the lock cavity 56 and allow the blade member 10 to be rotated into an extended position.

A thumb stud 58 is preferably attached to the blade member 10 to facilitate rotation thereof relative to the first and second side plates. A first scale slot 59 is formed in a side of the first side plate 12 to receive the first scale plate 60 and a second scale slot 61 is formed in a side of the second side plate 14 to receive the second scale plate 62. The first and second scale plates are attached to the first and second side plates with any suitable assembly method such as threaded fasteners.

Figure 8A:
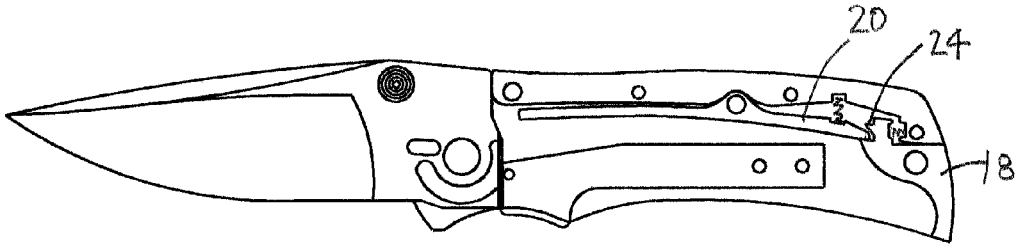
FIG. 8*a* is a front view of a folding knife having two modes of operation with a second side plate removed and set in a manual mode in accordance with the present invention.
Figure 8B:
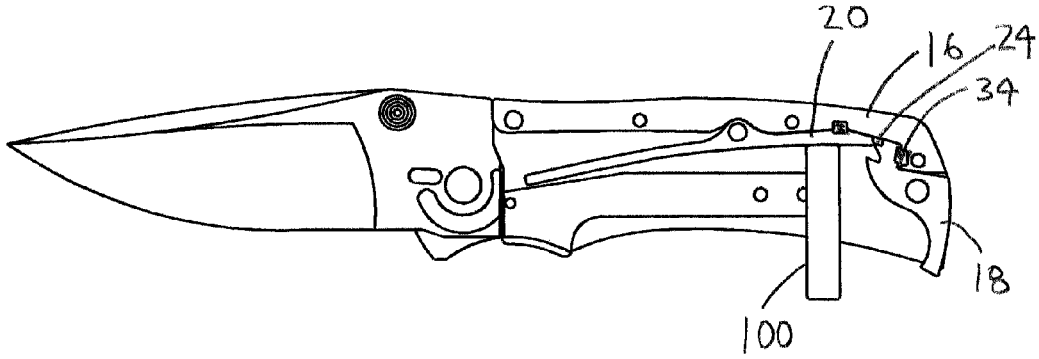
FIG. 8*b* is a front view of a folding knife having two modes of operation with a second side plate removed and being set in a spring assisted mode with a tool in accordance with the present invention.
Figure 8C:
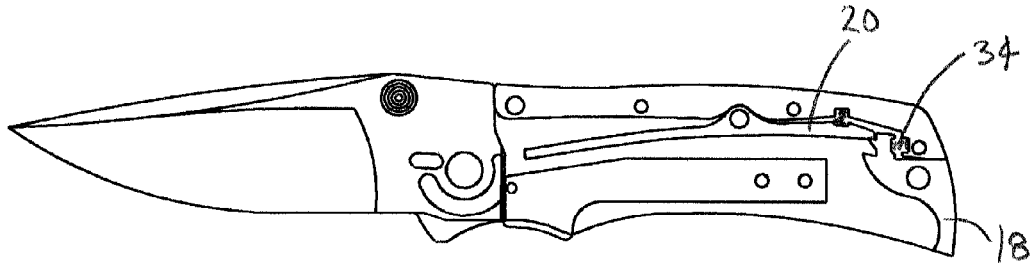
FIG. 8*c* is a front view of a folding knife having two modes of operation with a second side plate removed and set in a spring assisted mode in accordance with the present invention.
Figure 9A:
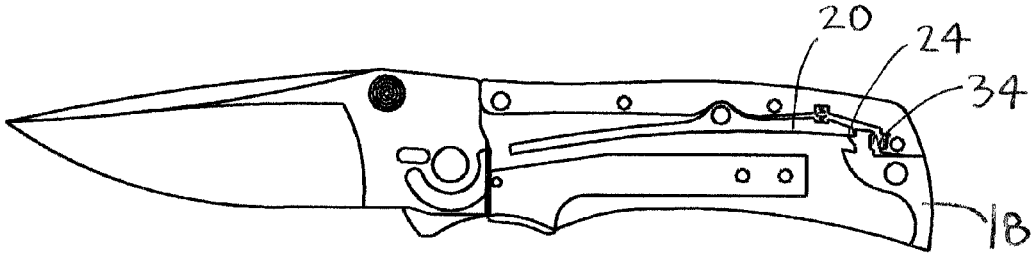
FIG. 9*a* is a front view of a folding knife having two modes of operation with a second side plate removed and set in a spring assisted mode in accordance with the present invention.
Figure 9B:
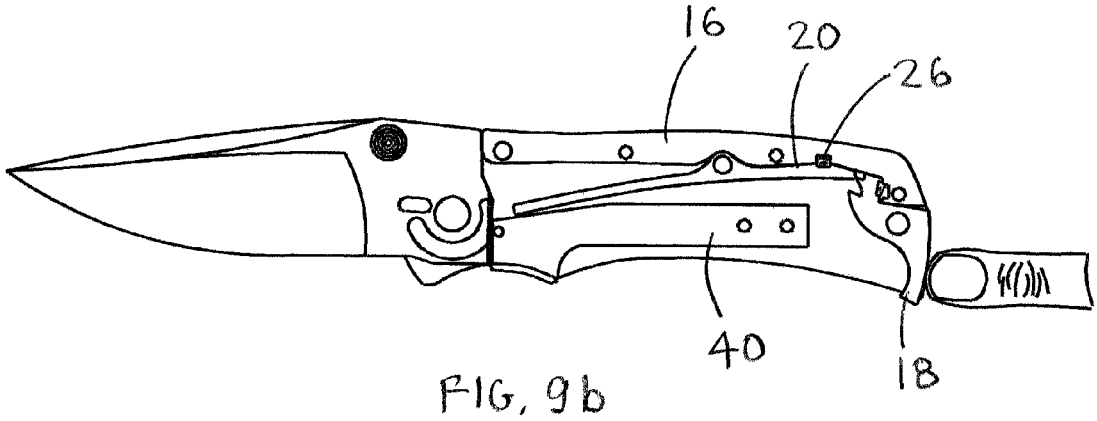
FIG. 9*b* is a front view of a folding knife having two modes of operation with a second side plate removed and being set into a manual mode by depressing a mode lever in accordance with the present invention.
Figure 9C:
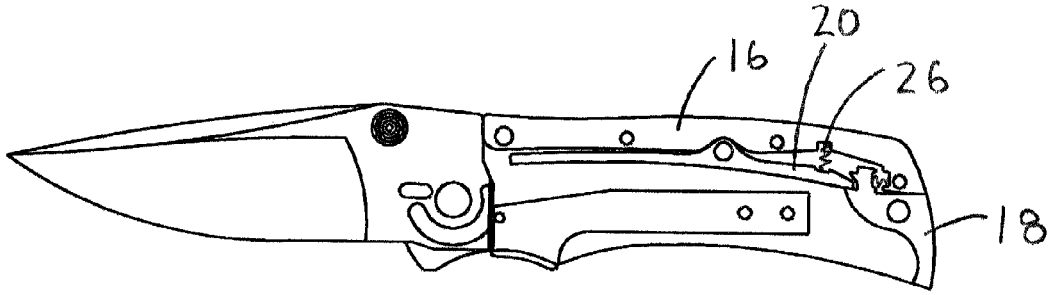
FIG. 9*c* is a front view of a folding knife having two modes of operation with a second side plate removed and set in a manual mode in accordance with the present invention.

Changing modes requires the blade member 10 to be in an extended position. With reference to FIGS. 8*a*-8*c*, changing from a manual mode to a spring assisted mode requires that a tool 100 be slipped between the first and second side plates, adjacent the mode lever 18. The one end of the linear spring 20 is forced upward with the tool 100 until it contacts a bottom of the spacer 16. The one end of the linear spring 20 will seat into the spring assisted step 24 when the mode spring 34 pushes the first end of the mode lever 18 inward. With reference to FIGS. 9*a*-9*c*, changing from a spring assisted mode to a manual mode of operation, requires that a bottom of the mode lever 18 be pushed inward. The one end of the linear spring 20 will seat in the manual step 22 when the step spring 26 pushes the linear spring 20 away from the spacer 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A folding knife having two modes of operation comprising:

a first side plate;

a second side plate;

a blade member being pivotally retained at one end between said first and second side plates;

a linear spring being pivotally retained between said first and second side plates; and a mode lever being pivotally retained between said first and second side plates, a manual step being formed on a first end of said mode lever, a spring assisted step being formed adjacent said manual step, one end of said linear spring engaging with one of said steps.

2. The folding knife having two modes of operation of claim 1, further comprising:

a mode spring for retaining said linear spring in one of a manual mode and a spring assisted mode.

3. The folding knife having two modes of operation of claim 1, further comprising:

a lock bar being attached to one of said side plates, said lock bar preventing the rotation of said blade member from an extended position.

4. The folding knife having two modes of operation of claim 1, further comprising:

a spacer being disposed between said first and second side plates.

5. The folding knife having two modes of operation of claim 1 wherein:

said linear spring biasing said blade member to an extended position while in a retracted position and a spring assisted mode.

6. A folding knife having two modes of operation comprising:

a first side plate;

a second side plate;

a blade member being pivotally retained at one end between said first and second side plates;

a linear spring being pivotally retained between said first and second side plates;

a mode lever being pivotally retained between said first and second side plates, a manual step being formed on a first end of said mode lever, a spring assisted step being formed adjacent said manual step, one end of said linear spring engaging with one of said steps; and a release button being disposed in one of said side plates, depressing said release button to release said blade member from a retracted position.

7. The folding knife having two modes of operation of claim 6, further comprising:

a mode spring for retaining said linear spring in one of a manual mode and a spring assisted mode.

8. The folding knife having two modes of operation of claim 6, further comprising:

a lock bar being attached to one of said side plates, said lock bar preventing the rotation of said blade member from an extended position.

9. The folding knife having two modes of operation of claim 6, further comprising:

a spacer being disposed between said first and second side plates.

10. The folding knife having two modes of operation of claim 6 wherein:

said linear spring biasing said blade member to an extended position while in a retracted position and a spring assisted mode.

11. The folding knife having two modes of operation of claim 6, further comprising:

a tool being used to engage said linear spring to change said mode from manual to spring assisted.

12. A folding knife having two modes of operation comprising:

a first side plate;

a second side plate;

a blade member being pivotally retained between said first and second side plates;

a linear spring being pivotally retained between said first and second side plates; and a mode lever being pivotally retained between said first and second side plates, a manual step being formed on a first end of said mode lever, a spring assisted step being formed adjacent said manual step, one end of said linear spring engaging one of said steps, a tool being used to engage said linear spring to change said mode from manual to spring assisted.

13. The folding knife having two modes of operation of claim 12, further comprising:

a release button being disposed in one of said side plates, depressing said release button to release said blade member from a retracted position.

14. The folding knife having two modes of operation of claim 12, further comprising:

a mode spring for retaining said linear spring in one of a manual mode and a spring assisted mode.

15. The folding knife having two modes of operation of claim 12, further comprising:

a lock bar being attached to one of said side plates, said lock bar preventing the rotation of said blade member from an extended position.

16. The folding knife having two modes of operation of claim 12, further comprising:

a spacer being disposed between said first and second side plates.

17. The folding knife having two modes of operation of claim 12 wherein:

said linear spring biasing said blade member to an extended position while in a retracted position and a spring assisted mode.

* * * * *